US006175961B1

(12) United States Patent
Linden et al.

(10) Patent No.: US 6,175,961 B1
(45) Date of Patent: Jan. 23, 2001

(54) T-SHIRT MODIFICATIONS

(76) Inventors: Nigel A. Linden; Nicola A. Linden, both of 40 Carriage La., Burnsville, MN (US) 55306

( * ) Notice: Under 35 U.S.C. 154(b), the term of this patent shall be extended for 0 days.

(21) Appl. No.: 09/444,275

(22) Filed: Nov. 19, 1999

(51) Int. Cl.[7] ..... A41B 1/08
(52) U.S. Cl. ..... 2/125; 2/125
(58) Field of Search ..... 2/125, 126, 270, 2/289, 321, 311, 312, 317, 170, 338, 920, 171, 115, 113, 69, DIG. 11; 24/306, 442

(56) References Cited

U.S. PATENT DOCUMENTS

| | | | | |
|---|---|---|---|---|
| 209,413 | * | 10/1878 | Moses | 2/125 |
| 237,096 | * | 2/1881 | Delmonte | 2/125 |
| 317,645 | | 5/1885 | Hayden . | |
| 521,259 | | 6/1894 | Davis . | |
| 1,199,950 | * | 10/1916 | Weary | 2/125 |
| 4,475,252 | * | 10/1984 | Peyser et al. | 2/125 |
| 5,404,592 | | 4/1995 | Jackson . | |
| 5,555,561 | * | 9/1996 | Plachta et al. | 2/270 |
| 5,692,239 | | 12/1997 | Lewis . | |
| 6,081,925 | * | 7/2000 | Reiber | 2/125 |

* cited by examiner

*Primary Examiner*—Gloria M. Hale
*Assistant Examiner*—Tejash Patel
(74) *Attorney, Agent, or Firm*—R. C. Baker & Associates, Ltd.

(57) ABSTRACT

The structure of a T-shirt is modified without removal of any of the fabric of the T-shirt. Fabric of the T-shirt neck opening at a portion adjacent a first shoulder portion of the T-shirt is pulled into a V-shape with the apex of the V-shape pointed toward said first shoulder of the T-shirt. Fabric of the sleeve opening for said first shoulder is pulled upward toward said first shoulder so as to cause the sleeve opening to form a V-shape with the apex of the V-shape pointed toward the V-shape of the neck opening. The fabric between the V-shape of the neck opening and the V-shape of the sleeve opening is secured in a gathered condition along a line on the shoulder of the T-shirt. The line of gathered T-shirt fabric between the V-shaped neck and sleeve openings is between approximately 1 and 4 inches in length. The gathered fabric is ideally secured in gathered condition by entraining it within a substantially flattened coil made of plastic or metal, and the coil rests on the shoulder of the wearer of the modified T-shirt.

9 Claims, 3 Drawing Sheets

T-SHIRT MODIFICATIONS

BACKGROUND OF THE INVENTION

This invention is directed to T-shirt modifications and more particularly to methods, structures, and articles for modifying the neck, sleeve, and shoulder area of a T-shirt.

T-shirts have become ubiquitous. They are everywhere. But insofar as is known, only the use of different designs on them has been employed to create distinctiveness for one T-shirt over another. Nothing in the styling of T-shirts as heretofore marketed in commerce is known to point to or suggest a modification of the shoulder area that would cause that area as well as the neck and sleeve openings of the T-shirt to change in their relationship to each other and present a unique structure and novel comfort feeling.

This invention modifies the T-shirt neck and sleeve openings and achieves a unique shoulder effect that is not only strikingly attractive but also creates an unexpected novel comfort aspect.

SUMMARY OF THE INVENTION

The invention is directed to modification of T-shirts without removal of any of the fabric of the T-shirt. The modification effectively converts the fabric of the T-shirt neck opening (which is of generally rounded configuration) into a neck opening having a V-shaped portion with the apex of the V pointed toward a shoulder area (e.g., first shoulder area) of the T-shirt and effectively converts the fabric of the sleeve opening for the same shoulder area into a V-shaped portion with the apex of the V-shape pointed toward the V-shaped neck opening, and still further, effectively pulls fabric of the neck opening toward fabric of the sleeve opening and pulls fabric of the sleeve opening toward fabric of the neck opening so as to gather fabric between the neck opening and sleeve opening along a line extending therebetween and located on the shoulder area of the T-shirt.

In other words, the invention causes the fabric between a neck and sleeve opening to be pulled together to a rather drastic extent, with the neck and sleeve openings each altered to present a V-shaped portion with the apex of the V-shapes in an opposing relationship, and with fabric between the neck and sleeve openings gathered together on a shoulder area of the T-shirt. Further, the underarm sleeve fabric of the T-shirt is put in a bunched together condition such that it is effectively pulled upward toward the armpit of the wearer.

Not only does this invention provide a means of adornment, it is also practical in that it keeps the T-shirt sleeve clear for ease of arm movements for sporting activities.

A variety of techniques may be used to hold the neck, sleeve, and shoulder areas in modified condition. Ideally the neck opening and sleeve opening are held in pulled-together condition by a coil formed from a plastic or metal rod (which in cross-section may be varied in shape). The coil may be substantially flattened but never completely crushed to a flattened condition. Illustratively, the structure of a substantially flattened coil may include a length of rod as a spine. It may have end curvatures at each end of the spine which serve as holder abutments locking the fabric of the neck opening and the fabric of the sleeve opening against escape from the coil. Even a coil of slightly less than a totally complete loop can be useful. Coils of at least one complete loop up to about three complete loops are considered particularly fashionable and functionally effective. The coil must have a space between any parts that are substantially flattened together so as to accommodate fabric between those parts.

Several further details and features and advantages of the invention will be evident as this description proceeds.

DESCRIPTION OF THE PREFERRED EMBODIMENT

Figure 1:
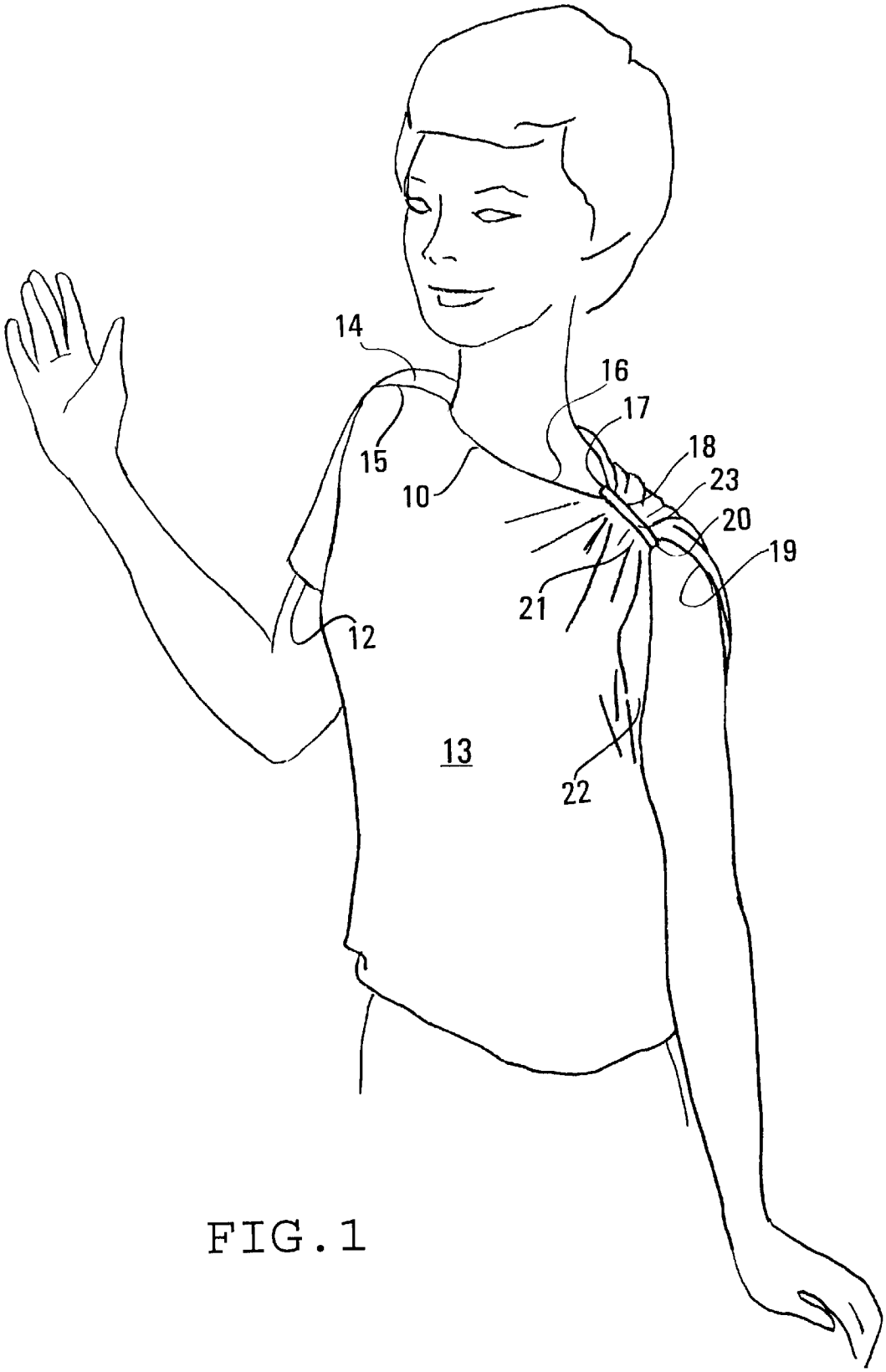
FIG. 1 is a schematic perspective illustration of a person wearing a T-shirt having one shoulder area (e.g., a first shoulder area) modified in accordance with the practice of the invention.

Reference is first made to FIG. 1 for the purpose of giving an explanation as to the parts of a T-shirt as they are understood and affected by this invention.

The conventional T-shirt is well known to have a generally rounded or circular neck opening 10. It lacks a collar. It quite literally lies as a flat, substantially rounded neck opening about the neck of a wearer, except as modified by this invention.

Likewise, the sleeve opening 12 of a T-shirt has heretofore been at approximately the mid-biceps portion of the arm of the wearer. In the fabricating of T-shirts, the front 13 and back 14 panels are generally sewn together at shoulder area side seams as at 15, and at torso side seams (not shown). A shoulder seam 15 extends between the neck opening to the outer end of the shoulder. It is emphasized that a shoulder area of a T-shirt is one that extends over the uppermost portion of a shoulder part of the front 13 and back 14 panels of the T-shirt and includes the shoulder seam 15.

It should be recognized that, while the pattern of sewing for T-shirts (as for example the lines of sewing between the front and back panel of a T-shirt and the sleeve portion of a T-shirt) can vary, and the cuts of fabric for T-shirts may vary. Nevertheless, the essence of T-shirts is that they have a generally rounded neck opening and a rounded sleeve opening that normally falls to, or normally lies at, approximately the mid-biceps portion of the wearer.

The method for modifying the structure of a T-shirt in accordance with the invention is accomplished without need to remove any of the fabric that is part of a T-shirt as conventionally made and aforedescribed. The method pulls the neck opening 10 away from its circular or rounded configuration into a V-shaped condition 16 having the point or apex 17 of the V-shape directed toward a shoulder portion 18. Further, the sleeve opening of the T-shirt is pulled into a V-shape 19 having the apex 20 of its V-shape pointed toward the apex portion 17 of the neck opening. This is accomplished by pulling the fabric of the T-shirt at and between the neck opening and the sleeve opening into a gathered condition 21 above the shoulder. Simultaneously, this causes the sleeve fabric that is located under the arm of a wearer to be pulled upward toward the armpit of the wearer. The sleeve fabric 22 under the arm of the wearer is bunched together at the armpit of the wearer.

Of dominant significance is the fact that the rounded neck opening of the T-shirt is converted at its edge into a neck opening having a substantially V-shaped portion with the apex 17 of the V-shape pointed toward a shoulder of the T-shirt, and the sleeve opening off that shoulder is likewise converted at its edge into a sleeve opening having a substantially V-shape with its apex pointed toward the shoulder and also toward the pointed condition of the neck opening. This is the essence of the invention. The neck opening and sleeve opening are pulled together in a compact stretch no more than 4 inches in length and preferably somewhere between about 2 and 3 inches in length. The drastic pulling of the neck and sleeve openings together in practicing the invention gives an entirely modified but striking and attractive structure to the T-shirt and unexpected comfort for the wearer for sporting activities.

The gathered fabric is held in gathered condition by the practice of the invention. Ideally, this is accomplished by using coils of plastic or metal rod material, whether the coils are single loop, multiple loop, or slightly short of a single loop. Still further, the coils preferably are substantially flattened but not entirely flattened.

Figure 2A:
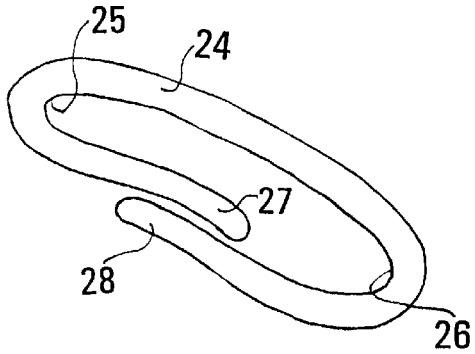
FIG. 2A is a schematic perspective view of a single loop substantially flattened coil for holding the T-shirt in modified condition; the coil is formed from a rod of material having a circular cross-section as illustrated in FIG. 2B.
Figure 3A:
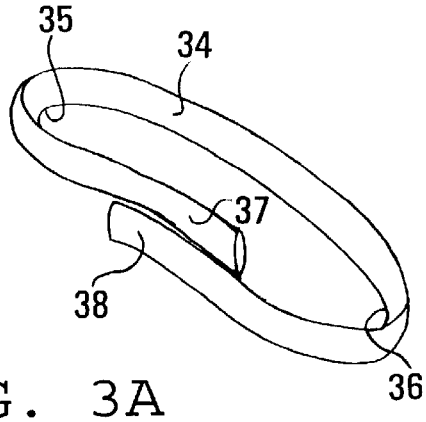
FIG. 3A is a schematic perspective view of another embodiment for a single loop substantially flattened coil of the invention, this one being formed from a rod of material having a cross-section of generally oval character as illustrated in FIG. 3B.
Figure 3B:
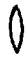
Figure 4A:
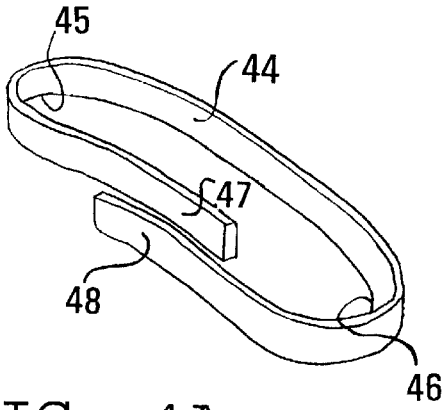
FIG. 4A is a schematic perspective view of yet another variation for a single loop substantially flattened coil of the invention; in this instance the rod of material forming the single loop coil is of substantially rectangular character in cross-section as illustrated in FIG. 4B.

In FIG. 1, a spine stretch 23 of a single-loop plastic or metal coil such as illustrated in FIGS. 2A, 3A, and 4A presents a visible gathering element (i.e., spine 23) to an observer. The spine 23 in FIG. 1 is the same as the spine in FIG. 2A at 24 (or 34 in FIG. 3A or 44 in FIG. 4A). The overlapping terminal ends 27 and 28 of the substantially flattened coil in FIG. 2A (or 37 and 38 in FIG. 3A, or 47 and 48 in FIG. 4A) are underneath the gathering of the fabric as the gathering is illustrated in FIG. 1. The apex 17 of the neck fabric V-shape is held in abutted condition within the hook-like portion 25 of FIG. 2A (or 35 of FIG. 3A, or 45 of FIG. 4A), whereas the apex 20 for the substantially V-shaped sleeve structure is held in abutted condition by hook-like portion 26 of FIG. 2A (or 36 of FIG. 3A, or 46 of FIG. 4A).

The distance between the internal surfaces of the looped or abutment ends (as at numerals 25 and 26 of FIG. 2A) is never less than about 1 inch and never in excess of about 4 inches. Preferably that distance should lie within the range of about 2 and 3 inches.

Figure 2B:
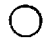

Terminal ends of the single loop coils (as for example at 27 and 28 in FIG. 2) preferably overlap. The overlap suitably may be as little as about ¼ inch up to an inch or so. A greater overlap is possible but unnecessary and cumbersome. A slight overlap contributes to a holding of fabric in the gathered condition without accidental slippage of it out of the confines of the substantially flattened coil. The overlapped terminal ends 27 and 28 may be slightly spaced laterally from each other (e.g., up to possibly as much as ⅛ inch or so), although they may also be immediately adjacent each other. It is emphasized in this respect that the rod material of plastic or metal forming the coils should be yieldable, similar to the yieldability of a coiled spring. Thus, the terminal ends may be spread apart as the fabric is entrained for positioning within the confines of the coil, and then, after the fabric is within the coil, these ends will tend to spring back (or be moved back) toward the condition they had before being spread apart to insert fabric within the coil.

The substantially flattened coils critically must not be squashed together to form essentially minimal or zero spacing between the opposing flattened sides (such as the spine side 24 in FIG. 2A and the opposing side having the terminal ends 27 and 28). In other words, there must be a space or distance between the length of coil illustrated as a "spine" at 24 in FIG. 2A and the lateral lengths of coil terminating at the ends 27 and 28 in FIG. 2A. This space should never be less then approximately ⅜ inch and preferably will be at least about ½ inch but no more than about ¼ inch, except, of course, when non-flattened coils are employed of substantially circular configuration. The problem with non-flattened coils, however, is that they are bulky and create an unnecessary feeling of discomfort. By employing substantially flattened coils as described, the wearer experiences comfort not only from a physical standpoint but also from a psychological standpoint.

Figure 4B:
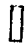

Rod material for practicing the invention will always have a cross-section measurement of at least 1/16 inch in all directions. Preferably, when the rod is as thin as only about 1/16 inch in any one direction, it should have a thickness at least two times or even at least three times greater in a perpendicular direction to that first dimension. Thus, if a rectangular cross-section is employed as illustrated in FIGS. 4A and 4B, and the thickness of that rectangular section in its thinnest cross-sectional direction is no more than about 1/16 inch, the perpendicular direction to that should be at least ⅛ inch and preferably at least 3/16 inch. When rounded or circular cross-sections are employed as in FIGS. 2A and 2B, the diameter of the circular cross-section should be at least as large as ⅛ inch and preferably larger, such as 3/16 inch, or even ¼ inch or more. Thicknesses as great as ⅜ inch or ½ inch or even up to 2 inches can create a dramatic effect; preferably the greatest thickness dimension should lie in a direction parallel to the central opening (e.g., parallel to the axis) of the coil. Cross-sections having a thickness dimension in excess of 2 or 3 inches (even if the thickness in a transverse dimension is only a fraction of 1 inch) are generally too clumsy for purposes of the invention. Small increments of the total length of a rod may be of greater thickness in one or more dimensions than other sections or parts of the total length of a rod. This may be done to create special designs or sculptures in different parts of the coiled rod. The spine or other parts of the coil may even have a decorative element attached thereto.

Figure 5:
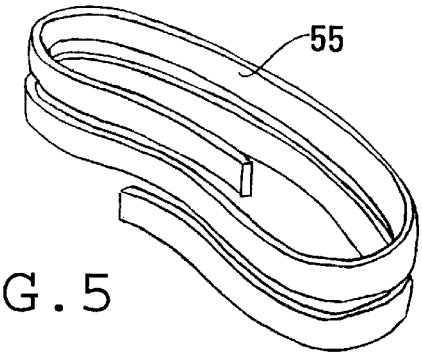
FIG. 5 is a schematic perspective illustration of a substantially flattened coil having two complete loops.

The purpose of FIG. 5 is to illustrate that coils in excess of one complete loop—such as one having two complete loops 55 as illustrated in FIG. 5—can be useful and even highly desirable. The relative thickness and cross-sectional shape of the rod material used for making coils of more than one loop up to three and even possibly more loops are as aforediscussed in connection with the single loop coils of FIGS. 2A, 3A, and 4A.

Where a complete loop of coiled material is employed or a plurality of loops are employed, it is necessary to thread the substantially flattened coil about the fabric of the T-shirt at the shoulder area and the upper sleeve area of the T-shirt so that the neck opening and the sleeve opening ultimately lodge at opposite ends of the substantially flattened coil.

Figure 6:
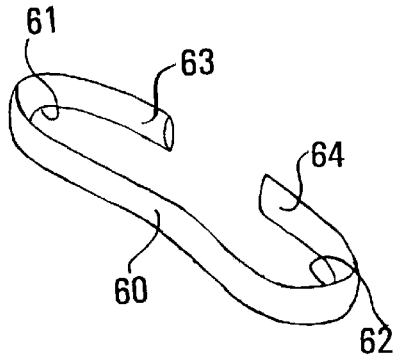
FIG. 6 is a schematic illustration of a coil having slightly less than a complete loop but nevertheless capable of being employed in the practice of the invention, especially to make modified shirts for sporting activities; (the coils illustrated in FIGS. 5 and 6 may be constructed of cross-sections such as illustrated in FIGS. 2B, 3B, and 4B)
Figure 7:
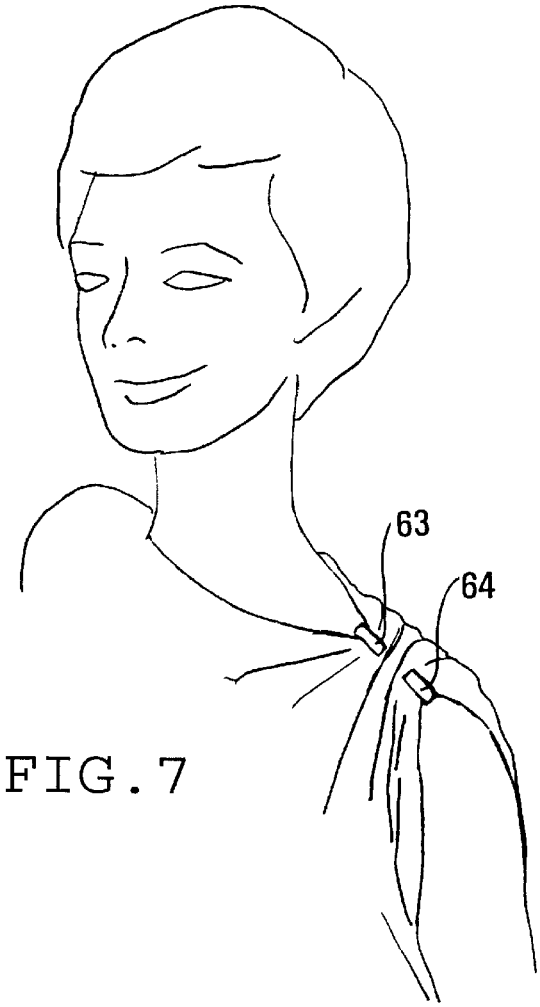
FIG. 7 is yet another illustration of the modified T-shirt of the invention employing in this instance the flattened coil of slightly less than one complete loop as illustrated in FIG. 6.

FIGS. 6 and 7 are included to illustrate that, where desired, a coil of less than a perfect single complete loop may be employed and flattened so that one flattened side 60 extends as a unifying spine between curved ends 61 and 62 that form holding abutments for gathered fabric. The terminal ends 63 and 64 of the single loop coil in FIG. 6 are in spaced relationship and are flattened toward the spine length 60, but spaced therefrom as discussed for the substantially flattened coil illustrated in FIG. 2A. The terminal ends 63 and 64 may be placed as holders either underneath or in an exposed condition as illustrated in FIG. 7 for the gathering of fabric.

To be noted is that the substantially flattened coils may be slightly contoured along their lengthwise direction to contribute to a comfort feeling for a wearer. In keeping with that principle, it is also possible to contour the opposing elongated sides of substantially flattened coils for comfort or attractive structural effects.

Coils of the invention may be formed from highly economical materials, especially plastics such as polyethylene, or from any of a number of other known plastics. However, metals may also be useful and can sometimes be an economical option. The material of the coil should exhibit bendability (or yieldability) and resilience to recover from a distorted condition. The more brittle plastics such as some polystyrenes can even be used, but are much less preferred. It is the materials of more ready yieldability and springiness to recover from a distorted or yielded condition that are more preferred. Any desired color or variation of color may be employed, including multiple colors for a single coil and variegated arrangements of color.

Those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. A method of modifying the structure of a T-shirt without removal of any of the fabric of the T-shirt, comprising pulling the fabric of a T-shirt neck opening at a portion adjacent a first shoulder of the T-shirt into a V-shape having an apex pointed toward said first shoulder of the T-shirt, and pulling the fabric of a sleeve opening adjacent said first shoulder upward toward said first shoulder so as to cause the sleeve opening to form a V-shape having an apex pointed toward the V-shape of the neck opening, and seeing the fabric of the T-shirt between the V-shape of the neck opening and the V-shape of the sleeve opening in a gathered condition along a line on the shoulder of the T-shirt, said step of securing the fabric of the T-shirt in a gathered condition being accomplished by entraining the fabric within a performed coil of a plastic or metal rod, said entraining comprising temporary distortion of said coil followed by resilient recovery of said coil to its original preformed shape after the fabric is entrained within it, line of gathered T-shirt fabric between the V-shaped neck and sleeve openings being between approximately 1 and 4 inches in length.

2. The method of claim 1 wherein said coil is substantially flattened before fabric of the T-shirt is entrained within it.

3. A T-shirt modified in structure without removal of any of the fabric of the T-shirt, said modified structure comprising a neck opening wherein the fabric has a generally V-shaped configuration having an apex pointed toward a first shoulder of the T-shirt, and a sleeve opening for said first shoulder wherein the fabric has a V-shaped configuration having an apex pointed toward the V-shaped configuration of the neck opening, with fabric of the T-shirt between the apex of the V-shaped neck opening and the apex of the V-shaped sleeve opening entrained in gathered condition within a preformed coil of a rod of plastic or metal; said coil being such that it resiliently returns to its original preformed shape after being temporarily distorted, said distance between said apexes of said V-shapes being between about 1 and 4 inches.

4. The modified T-shirt of claim 2 wherein said coil is substantially flattened.

5. A device for modifying the structure of a T-shirt by converting a T-shirt neck opening of generally round configuration into a V-shaped neck opening having an apex pointed toward a first shoulder of the T-shirt and by converting a T-shirt sleeve opening adjacent said first shoulder into a V-shaped sleeve opening having an apex pointed toward the V-shape of the neck opening, with the distance between the apex of the V-shape of the neck opening and the apex of the V-shape of the sleeve opening being between about 1 and 4 inches and with all fabric of the T-shirt between the apex of the neck opening and the apex of the sleeve opening in gathered condition on the shoulder of the T-shirt, said device comprising a substantially flattened coil of plastic or metal material having a preformed shape and having at least one substantially flattened side in the form of a continuous spine of a length between about 1 inch and 4 inches and having an internal distance between said one substantially flattened side and the opposing side of said coil at least in excess of ¼ inch so as to accommodate gathered fabric along the shoulder of a T-shirt within said coil.

6. A method of modifying the structure of a T-shirt without removal of any of the fabric of the T-shirt, comprising pulling the fabric of the a T-shirt neck opening at a portion adjacent a first shoulder of the T-shirt into a V-shape having an apex pointed toward said first shoulder of the T-shirt, and pulling the fabric of a sleeve opening adjacent said first shoulder upward toward said first shoulder so as to cause the sleeve opening to form a V-shape having an apex pointed toward the V-shape of the neck opening, and securing the fabric of the T-shirt between the V-shape of the neck opening and the V-shape of the sleeve opening in a gathered condition along a line on the shoulder of the T-shirt, said step of securing the fabric of the T-shirt in a gathered condition being accomplished by entraining the fabric within a loop of a plastic or metal rod preformed into a contoured shape having a substantially flattened side as a unit spine between curved ends of the rod, said entrain comprising temporary distortion of said loop followed by resilient recovery of said loop to its original preformed shape after the fabric is entrained within it, said line of gathered T-shirt fabric between the V-shaped neck and sleeve openings being between approximately 1 and 4 inches in length.

7. A T-shirt modified in structure without removal of any of the fabric of the T-shirt, said modified structure comprising a neck opening wherein the fabric has a generally V-shaped configuration having an apex pointed toward a first shoulder of the T-shirt, and a sleeve opening for said first shoulder wherein the fabric also has a V-shaped configuration having an apex pointed toward the V-shaped configuration of the neck opening, with fabric of the T-shirt between the apex of the V-shaped neck opening and the apex of the V-shaped sleeve opening entrained in gathered condition within a loop of a rod of plastic or metal preformed into a contoured shape having a substantially flattened side as a unifying spine between curved ends of said rod, said loop being such that it resiliently returns to its preformed shape after being temporarily distorted, said distance between said apexes of said V-shapes being between about 1 and 4 inches.

8. A T-shirt modified in structure without removal of any of the fabric of the T-shirt, said modified structure comprising a neck opening wherein the fabric has a generally V-shaped neck configuration having an apex pointed toward a first shoulder of the T-shirt, and a sleeve opening for said first shoulder wherein the fabric has a V-shaped configuration having an apex pointed toward the V-shaped configuration of the neck opening, with fabric of the T-shirt between the apex of the V-shaped neck opening and the V-shaped sleeve opening entrained in gathered condition within a loop formed by a rod of plastic or metal, said loop being preformed into a contoured shape having a substantially flattened side as a unifying spine between curved ends of said rod, said ends of said rod being not in overlapped condition, said loop being such that it resiliently returns to its preformed shape after being temporarily distorted, said distance between said apexes of said V-shapes being between about 1 and 4 inches, said apexes being within said curved ends of said rod.

9. A device for modifying the structure of a T-shirt by converting a T-shirt neck opening of generally round configuration into a V-shaped neck opening having an apex pointed toward a first shoulder of the T-shirt and by converting a T-shirt sleeve opening adjacent said first shoulder into a V-shaped sleeve opening having an apex pointed toward the V-shape of the neck opening, with the distance between the apex of the V-shape of the neck opening and the apex of the V-shape of the sleeve opening being between about 1 and 4 inches and with all fabric of the T-shirt between the apex of the neck opening and the apex of the sleeve opening in gathered condition on the shoulder of the T-shirt, said device comprising a loop of a plastic or metal rod preformed into a contoured shape having a substantially flattened side as a unifying spine between curved ends of said rod, said curved ends being not overlapped, said spine having a length between about 1 inch and 4 inches, said loop having an internal distance between said substantially flattened side and the opposing side of said loop at least in excess of ¼ inch so as to accommodate gathered fabric along the shoulder of a T-shirt within said coil, said loop being such that it resiliently returns to its preformed shape after being temporarily distorted.

* * * * *

UNITED STATES PATENT AND TRADEMARK OFFICE

CERTIFICATE OF CORRECTION

PATENT NO : 6,175,961

DATED : Jan. 23, 2001

INVENTOR(S) : Nigel A. Linden; Nicola A. Linden

It is certified that error appears in the above-identified patent and that said Letters Patent is hereby corrected as shown below:

Col. 4, line 21, "1/4 inch" should read -3/4 inch-.

<u>In the Patent claims</u>:

Col. 5, line 54, "and seeing" should read --and securing--.

Col. 5, line 59 "within a per-" should read --within a pre- --.

Col. 5, line 63, "it, line" should read --it, said line--.

Col. 6, line 11, "metal; said" should read --metal, said--.

Col. 6, line 16, "of claim 2" should read --of claim 3--.

Col. 6, line 53, "as a unit spine" should read --as a unifying spine--.

Col. 6, line 54, "said entrain comprising" should read --said entraining comprising--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*